US006695238B2

(12) United States Patent
Inoki et al.

(10) Patent No.: US 6,695,238 B2
(45) Date of Patent: Feb. 24, 2004

(54) DEVICE FOR PULVERIZING DESICCATED BULK PRODUCT IN A FREEZE-DRYING APPARATUS FOR FOODSTUFFS, MEDICAMENTS, AND SO FORTH

(75) Inventors: Masahiro Inoki, Osaka (JP); Tsunehiro Yoshidomi, Osaka (JP)

(73) Assignees: Kyowa Vacuum Engineering Co. Ltd., Tokyo (JP); Hosokawa Micron Co. Ltd., Osaka ( * ) Notice: Subject to any disclaimer, the term of this patent is extended or adjusted under 35 U.S.C. 154(b) by 49 days.

(21) Appl. No.: 10/091,118

(22) Filed: Mar. 6, 2002

(65) Prior Publication Data

US 2003/0006326 A1 Jan. 9, 2003

(30) Foreign Application Priority Data

Jul. 6, 2001 (JP) ..... 2001-205923

(51) Int. Cl.[7] ..... B02C 19/06

(52) U.S. Cl. ..... 241/39; 241/65

(58) Field of Search ..... 241/5, 39, 65; 34/289, 287, 298

(56) References Cited

U.S. PATENT DOCUMENTS

| | | | | | |
|---|---|---|---|---|---|
| 3,257,731 | A | * | 6/1966 | Vigano | 34/289 |
| 3,300,868 | A | * | 1/1967 | Anderwert | 34/291 |
| 3,612,411 | A | * | 10/1971 | Oetjen et al. | 241/23 |
| 4,614,000 | A | * | 9/1986 | Mayer | 5/484 |
| 5,090,132 | A | * | 2/1992 | Kobayashi et al. | 34/302 |
| 5,716,751 | A | * | 2/1998 | Bertrand et al. | 430/137.18 |

FOREIGN PATENT DOCUMENTS

GB 727 918 A * 4/1955

* cited by examiner

*Primary Examiner*—Mark Rosenbaum
*Assistant Examiner*—J Nguyen
(74) *Attorney, Agent, or Firm*—Browdy and Neimark, P.L.L.C.

(57) ABSTRACT

Liquid material is caused to freeze as a molded frozen body in a cylindrical form after the shape of the tubular inner wall surface of the freeze-drying apparatus, wherein the moisture content of the molded frozen material is sublimated under the vacuum to freeze-dry the material in the apparatus. A discharge port is defined at the lower end side of the tube, and jet nozzles are disposed, in the inner wall surface of the tube, for ejecting compressed air or gas toward the inner bore of the tube. The molded frozen body of the liquid material as freeze-dried is crushed and pulverized within the tube, by jet current ejected from jet nozzles.

17 Claims, 7 Drawing Sheets

DEVICE FOR PULVERIZING DESICCATED BULK PRODUCT IN A FREEZE-DRYING APPARATUS FOR FOODSTUFFS, MEDICAMENTS, AND SO FORTH

BACKGROUND OF THE INVENTION a) Field of the Invention

This invention is concerned with improvement in a device for pulverizing desiccated bulk products such as foodstuffs, medicaments, and so forth. More particularly, it relates to a pulverizer for desiccated bulk products obtained from liquid material which has completed its desiccation in a drying means for freeze-drying foodstuffs, medicaments, etc. adjusted in their liquid form, followed by subjecting the same to desiccating treatment in drying chamber (desiccating compartment) of a freeze-drying apparatus.

b) Description of Prior Arts

Conventionally, pulverization of desiccated products (dried bulk products) obtained from liquid material of foodstuffs, medicaments, etc. has usually been done in such a manner that the liquid material as adjusted from starting materials is filled in a container or vessel such as trays, etc., followed by placing the container and the liquid material therein in the desiccating chamber (drying compartment) of a freeze-drying apparatus to cause the liquid material to freeze in the container, then sublimation heat is imparted to the liquid material as frozen, under the vacuum condition, to thereby sublimate the moisture content in the material. And, by further capturing the water vapor into a vacuum-discharge type cold-trap which communicates to the desiccating chamber, the liquid material is subjected to freeze-drying. After this, the desiccated product resulted from the liquid material which has completed its desiccation is taken out of the drying chamber for each and every container, and this desiccated product is discharged outside the container as the desiccated bulk product, which is then thrown into a pulverizing apparatus to be reduced to very fine powder.

The above-described pulverizing means for the desiccated product obtained from the liquid material of foodstuffs, medicaments, etc., which has been freeze-dried by the freeze-drying apparatus, possesses troublesome problems such that, for securing maintenance of sterilized condition and prevention of contamination risk, with respect to the intended powder product, it requires to pass through a step of carrying the desiccated product, as dried, from the desiccating chamber of the freeze-drying apparatus, together with the container therefor; a step of taking out the desiccated product from the container as transported in its bulky configuration; and a step of throwing the desiccated bulk product as taken outside into the intake port of the pulverizing device, each step having to be carried out in its state of being isolated from the external atmosphere, even though loading of the liquid material into the desiccating chamber of the freeze-drying apparatus is effected in such state isolated from the external atmosphere.

In reality, however, pulverization of the desiccated bulk product obtained from the liquid material, which has completed its drying, is almost impossible in view of the structure of the freeze-drying apparatus. To so desire is next to impossible.

SUMMARY OF THE INVENTION

The present invention has been made with a view to solving the abovementioned problems which were inherent in the conventional means, and aims at providing improved device which, in substance, is capable of carrying out pulverization of the desiccated bulk product obtained from the liquid material which has been freeze-dried within the main body of the freeze-drying apparatus.

In order to attain the abovementioned objective, the device according to the present invention has been completed on the basis of findings obtained from various studies and experiments about the construction of the freeze-drying apparatus as well as the shapes and properties of the desiccated bulk products obtained from the liquid material which has completed its desiccation.

That is to say, findings and knowledge obtained by the present inventor about the desiccating chamber of the freeze-drying apparatus is such that, if and when it is constructed in the form of an upright cylindrical tube, on the inner wall surface of which the liquid material is made to freeze in a molded frozen body of a hollow cylindrical form, then the water content (moisture) in this molded frozen body is sublimated under the vacuum conditions, followed by capturing the vapor by a vacuum exhaust type cold-trap connected to the upper end side of the tube, the desiccated product of the molded cylindrical frozen body which has completed its desiccation within the tube readily drops downward from the tube interior due to its dead weight, and that the desiccated product (dried bulk product) of the molded frozen body which has completed its desiccation within the tube is remarkably brittle, which is liable to be easily crushed even under a slight shock, and can be reduced to fine powder even by blowing of pressurized air to be ejected from a jet nozzle.

Therefore, when a discharge port, opening downward at the time of freeze-drying the molded frozen body of the liquid material which has been frozen in a hollow cylindrical shape, is defined at the bottom end side of the upright cylindrical tube intended to form the desiccating chamber of the freeze-drying apparatus, and, as soon as the molded frozen body of the liquid material completes its desiccation within the tube interior, a jet current to be ejected from the jet nozzle which is provided on the inner wall surface of the cylindrical wall of the tube or the axis position of the tube is blown from the side of the inner bore or the outer periphery of the cylindrical molded frozen body against the molded frozen body of the liquid material which had completed its desiccation in the tube interior, there could be obtained a result such that the molded frozen body of the liquid material which has completed its desiccation was crushed and comminuted in the tube interior to become able to be taken out of the discharge port at the lower end side of the tube.

And, at this time, a pressurized fluid nozzle for ejecting pressurized air or gas is installed at the side of the upper end of the tube of the upright cylindrical tube to constitute the desiccating chamber of the freeze-drying apparatus, or at the side of the base end of the duct to be connected to its upper end side, in such a manner that the pressurized fluid ejected from the nozzle may flow in and through the tube in the direction of from its upper part to its lower part. As soon as the freeze-drying of the molded frozen body of the liquid material within the tube is completed, this pressurized fluid nozzle is actuated to bring about a state where the pressurized fluid flows in and through the tube toward the discharge port to cause jet current to be ejected from the jet nozzle provided at the axial part in the inner bore of the tube, or in the inner wall surface of the cylindrical wall of the tube, to crush the molded frozen body which has completed desiccation, whereupon there was obtained a result such that the comminuted product of the molded frozen body which has been crushed within the tube becomes able to be taken outside, with high efficiency, along with the discharge port at the lower end side of the tube.

From the above, as the expedient for attaining the above-mentioned object, the present invention provides a pulverizing device for desiccated bulk product in a freeze-drying apparatus for foodstuffs, medicaments, and so forth, wherein the freeze-drying apparatus comprises: upright cylindrical tube for freezing liquid material onto the inner wall surface; a jacket surrounding the outer periphery of the tube to cause heat medium to circulate in its interior; and a duct communicatively connected to a vacuum exhaust system which is connected to the upper end side of the tube, the liquid material being frozen on the inner wall surface of the tube as a molded frozen body in a cylindrical form, then the moisture content in the material of the molded frozen body being sublimated under the vacuum condition to desiccate the liquid material by the freeze-drying. In such freeze-drying apparatus, the discharge port is provided at the lower end side of the tube, while the jet nozzle for ejecting pressurized air or gas toward the inner bore of the tube is disposed in the inner wall surface of the tube, thereby making it possible to grind or pulverize the molded frozen body of the liquid material, which has been freeze-dried within the tube, by means of the jet current ejected from the jet nozzle.

According to the present invention, in another aspect thereof, there is provided a pulverizing device for desiccated bulk product in a freeze-drying apparatus for foodstuffs, medicaments, and so forth, wherein the freeze-drying apparatus comprises: an upright cylindrical tube for freezing liquid material onto the inner wall surface; a jacket surrounding the outer periphery of the tube and causing heat medium to circulate in its interior; and a duct communicatively, connected to a vacuum exhaust system which is connected to the upper end side of the tube, the pulverizing device for desiccated bulk product being characterized in that a discharge port is provided at the lower end side of the tube, and a jet nozzle for ejecting pressurized gas or air against the inner wall surface of the tube is provided, to thereby pulverize the molded frozen body as freeze-dried in the tube by means of the jet current from this jet nozzle.

According to the present invention, in still another aspect thereof, there is provided a pulverizing device for desiccated bulk product in a freeze-drying apparatus for foodstuffs, medicaments, and so forth, as described above, the pulverizing device being characterized in that the pressurized fluid nozzle for ejecting pressurized air or gas into the upper end side of the tube or the duct connected to this upper end side of the tube is disposed in such a manner that the pressurized fluid ejected from the nozzle may be blown in and through the tube from the upper part of the tube toward the discharge port at its lower part, thereby making it possible that pulverization of the molded frozen body of the liquid material, which has been freeze-dried by freezing the same in the tube with the jet current from the jet nozzle disposed within the tube, may be effected in the current of the pressurized fluid which is blowing from the upper part to the lower part within the tube in and through the pressurized fluid nozzle.

Further, when a funnel-shaped inclined wall, holding the molded frozen body, which has just completed its desiccation by freezing the liquid material within the tube, in close contact with the lower edge side of the molded frozen body from below, is disposed at the lower end side of the tube, while a discharge port is defined at the lower end side of this inclined wall, and a jet nozzle for crushing and comminuting the molded frozen body by jet current is mounted on the wall surface of this inclined wall, or on the inner wall surface of the tube at a position right above this inclined wall, so that this jet current may be blown against the skirt part at the lower end of the molded frozen body held on the funnel-shaped inclined wall, there could be obtained a result such that the molded frozen body descended due to crushing of its lower end part to be sequentially crushed and pulverized from the lower end side, whereby the pulverized product of the molded frozen body was taken out from the discharge port.

In this case, when the pressurized fluid nozzle is provided at the upper end side of the tube or the base end side of the duct, so that the crushing and the pulverizing of the molded frozen body may be done in the pressurized fluid current ejected from the pressurized fluid nozzle blowing in and through the tube toward the discharge port, there could be obtained a result such that removal of the pulverized product from the discharge port could be done at a high efficiency.

From the above finding, it is other object of the present invention to provide a pulverizing device for desiccated bulk product in the freeze-drying apparatus for foodstuffs, medicaments, etc., which is constructed with an upright cylindrical tube for freezing the liquid material on its inner wall surface; a jacket surrounding the outer periphery of the tube and causing heat medium to be circulate in its inner part; and a duct communicated with a vacuum exhaust system which is connected to the upper end side of the tube, thereby freezing the liquid material on the inner wall surface of the tube in the form of a cylindrical molded frozen body, and sublimating the moisture content in the material of the molded frozen body under the vacuum condition, the molded frozen body of which is subjected to freeze-drying, the pulverizing device for the desiccated bulk product being characterized in that a funnel-shaped inclined wall, which holds the molded frozen body in close contact with the lower edge thereof, is mounted on the lower end side of the tube; that a jet nozzle for ejecting the jet current of pressurized air or gas against molded frozen body, as desiccated, the lower edge side of which is held on the inclined wall thereof, is mounted on the lower end part of the inner wall surface of the tube, at a position on the wall surface of the inclined wall or above its inclined wall, a discharge port being formed at the inclined descending side of the inclined wall to thereby comminute sequentially the molded frozen body from its lower end side with use of the jet current ejected from the jet nozzle and to discharge the pulverized product from the discharge port.

According to still other object of the present invention, there is provided a pulverizing device for desiccated bulk product in the freeze-drying apparatus for foodstuffs, medicaments, and so forth (as mentioned above) the pulverizing device being characterized in that the pressurized fluid nozzle for ejecting pressurized air or gas is provided on the upper end side of the tube or on the duct connected to the upper end side of the tube, in such a manner that the pressurized air or gas ejected therefrom may be blown in and through the inner bore of the tube from the upper part down to the discharge port below, by way of the inner bore (space) of the tube and the inner bore (space) of the funnel-shaped inclined wall, thereby making it possible that sequential crushing of the molded frozen body of the liquid material, which has been freeze-dried by freezing the same within the tube by the jet current from the jet nozzle provided at the lower end side of the tube, may be done in the flow of the pressurized fluid which is blown in the tube as well as the funnel-shaped inclined wall, through the pressurized fluid nozzle in the direction of from the upper position toward the discharge port.

Moreover, in this mode of embodiment, the cylindrical chamber is connected to an opening at the lower end side, by defining the opening at the lower part of the tube; a discharge port is provided at the bottom part of the chamber, in the inner surface side of which the jet nozzle for ejecting pressurized air or gas is mounted, and, as soon as the molded frozen body of the liquid material, which has completed its desiccation within the tube, drops from the tube interior into this chamber, the jet current from the jet nozzle is sprayed, whereby the crushed and comminuted products of the molded frozen body collide among themselves, or collide against the inner wall surface of the chamber, while they are gyrating within the chamber, to become pulverized by the jet current. Thus, crushing and pulverizing of the molded frozen body can be carried out efficiently.

In this mode of embodiment, there could also be obtained a result such that, if and when the pressurized fluid nozzle is mounted on the upper end side of the tube or the base end side of the duct, thereby making it possible that the pressurized fluid may be blown out of the inner bore of the tube into the exhaust port through the inner bore of the chamber, any reverse flow of the pulverized product to the side of the tube can be discharged with good efficiency.

According to further object of the present invention, there is provided, as the means for attaining the abovementioned object, a pulverizing device for desiccated bulk product in a freeze-drying apparatus for foodstuffs, medicaments, and so forth, which comprises: an upright cylindrical tube for freezing liquid material onto the inner wall surface; a jacket surrounding the outer periphery of the tube and causing heat medium to be circulated in its interior; and a duct communicatively connected to a vacuum exhaust system which is connected to the upper end side of the tube, the liquid material being frozen on the inner wall surface of the tube as a molded frozen body in a cylindrical form, then the moisture content in the material of the molded frozen body being sublimated under the vacuum condition to desiccate the liquid material by the freeze-drying, the pulverizing device for the desiccated bulk product being characterized in that a cylindrical chamber with the discharge port being defined in the bottom part of the tube is connected to the lower end side of the tube having an opening provided in the lower part thereof, the jet nozzle for ejecting jet current of pressurized air or gas is mounted on the inner surface side of the chamber, to thereby pulverize the molded frozen body of the liquid material, as freeze-dried in the tube, with the pressure as well as the jet current as ejected from the jet nozzle.

According to still further object of the present invention, there is provided a pulverizing device for desiccated bulk product in a freeze-drying apparatus for foodstuffs, medicaments, and so forth (as mentioned above), characterized in that the pressurized fluid nozzle for ejecting pressurized air or gas is provided in the duct to be connected to the upper end side of the tube or to the tube itself, in such a manner that the pressurized fluid ejected from the nozzle may be blown to the discharge port from the upper part, through the inner bore of the tube or the inner bore of the chamber, whereby crushing of the molded frozen body by the Jet current from the jet nozzle to be provided in the inner surface side of the chamber may be done within the flow of the pressurized fluid, which is ejected from this pressurized fluid nozzle and blown within the tube and the chamber, in the direction of from its upper part down to its lower part.

The foregoing objects, other objects as well as the specific construction and function of the pulverizing device for desiccated bulk product in the freeze-drying apparatus for foodstuffs, medicaments, and so forth, according to the present invention will become more apparent and understandable from the following detailed description thereof, when read in conjunction with the accompanying drawing.

BRIEF DESCRIPTION OF THE ACCOMPANYING DRAWING

DETAILED DESCRIPTION OF THE PREFERRED EMBODIMENTS

Figure 1:
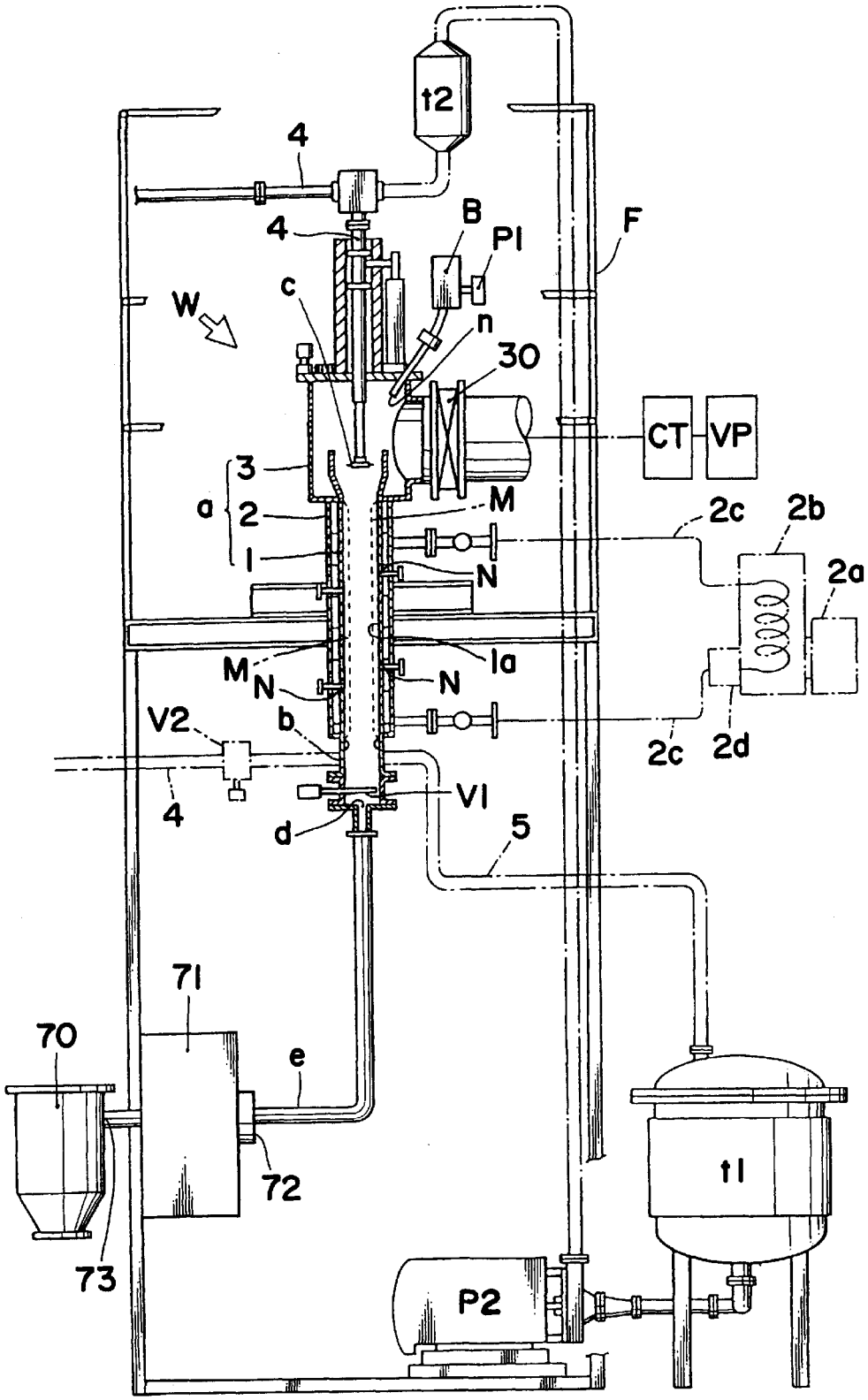
FIG. 1 is an overall front view, partly in longitudinal cross-section, of the pulverizing device for desiccated bulk product in the freeze-drying apparatus for foodstuffs, medicaments, and so forth, realizing the present invention.

The pulverizing device for desiccated bulk product of foodstuffs, medicaments, and so forth, which is freeze-dried in accordance with the present invention is constructed in such a manner that, for the freeze drying apparatus to desiccate liquid material into desiccated bulk product, use is made of a freeze-drying apparatus of a type, wherein the liquid material is frozen in a cylindrical form onto the inner wall surface of an upright cylindrical tube, and, subsequently, this frozen material is subjected to freeze-drying by feeding sublimation heat to the frozen material under the vacuum condition, the pulverizing device and the freeze-drying apparatus being combined by means of an upright cylindrical tube, which constitutes a desiccating chamber for the freeze drying apparatus Describing more concretely with reference to the embodiments shown in the accompanying drawing, a reference numeral 1 in FIG. 1 designates an upright cylindrical tube for freezing the liquid material into a hollow cylindrical shape, the axial line of which is defined in an upright cylindrical form.

A reference numeral 2 designates a jacket for cooling the tube 1 from its outer peripheral side to freeze the liquid material fed into this tube 1 in to a molded frozen body M in a hollow cylindrical shape, and for circulating heat medium which is to supply sublimation heat to the molded frozen body, the jacket being formed as an external cylindrical shape to surround the tube 1.

A reference numeral 3 designates a duct for freeze-drying the molded frozen body M of the liquid material which is frozen inside the tube 1 in a hollow cylindrical shape by capturing and removing vapor to be sublimated from the moldedfrozen body M, the duct being for connecting the inner bore of the tube 1 with a vacuum exhaust system equipped with a vacuum pump VP and a cold trap CT, the duct being connected to the upper end side of the tube 1 through a valve 30.

With these upright cylindrical tube 1; the jacket 2 surrounding the outer periphery of the tube, and for circulating heat medium; and the duct 3 communicated to the vacuum exhaust system which is connected to the upper end side of the tube 1, the liquid material poured into the upright cylindrical tube 1 is frozen onto the inner wall surface la of the tube 1 in the form of a hollow cylindrical molded frozen body M. These three components members constitute the principal part a of the freeze-drying apparatus W, which are mounted on a machine frame F to be installed in a desired location of the apparatus. At the same time, an expedient for pulverizing the molded frozen body M which has completed its desiccation is assembled to constitute thereby the pulverizing device for the desiccated bulk product in this freeze-drying apparatus.

Figure 2:
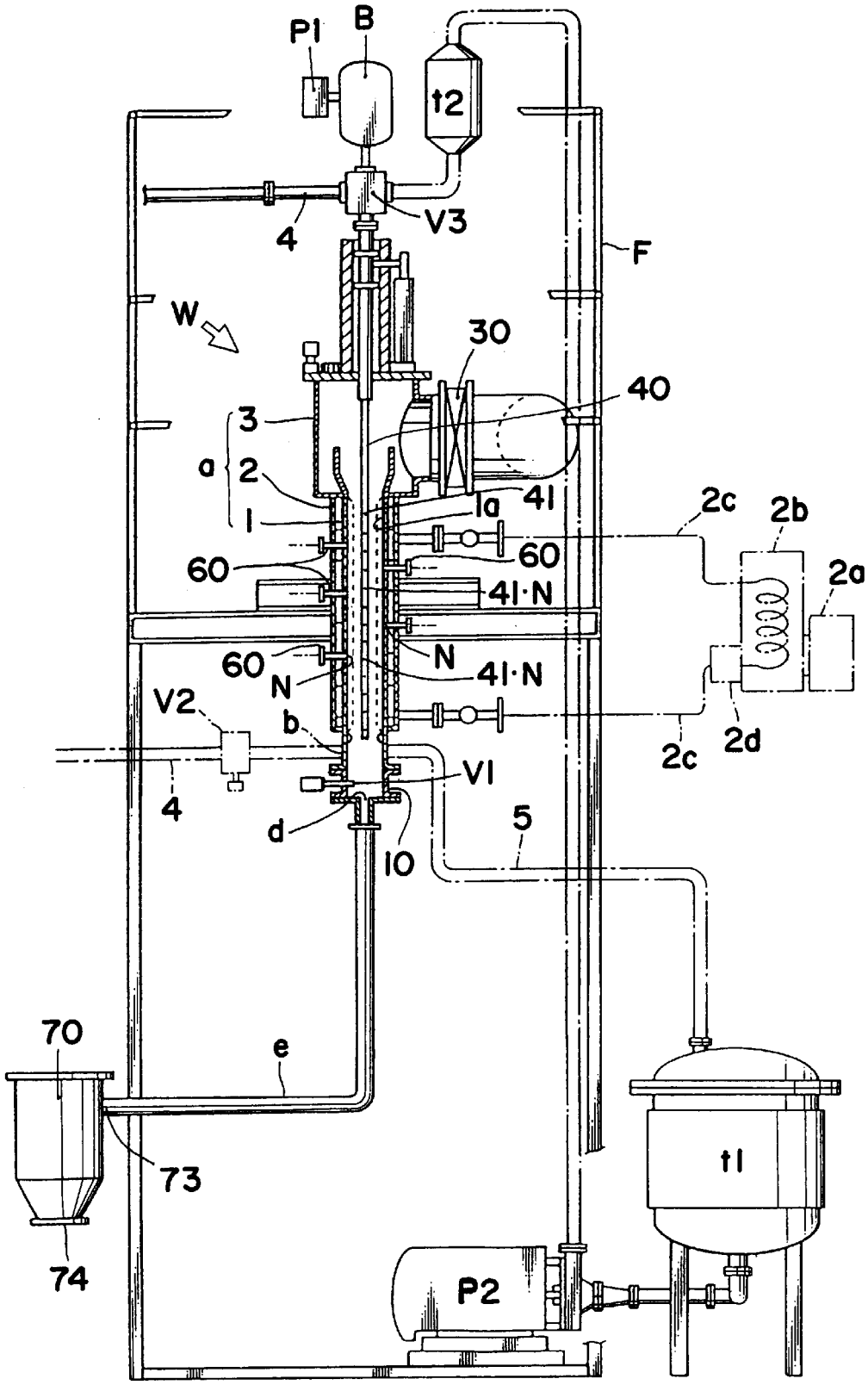
FIG. 2 is an overall front view, partly in longitudinal cross-section, of another embodiment of the pulverizing device for desiccated bulk product in the freeze-drying apparatus for foodstuffs, medicaments, and so forth, according to the present invention.

In the freeze-drying apparatus W of such construction, the device for feeding the liquid material into the upright cylindrical tube 1 thereof may be selected from any of the following appropriate means: that is, as shown by a broken line in FIG. 1, a feeding port b communicatively connected to the inner bore of the tube 1 is provided at a position immediately above a valve VI to be so provided as to open and close an opening at the lower end side of the tube 1, to which the downstream side of the tube passageway for leading the liquid material is joined by way of a valve V2 so as to feed the liquid material into the tube 1 from this feeding port b in a manner to push up the liquid material into the tube 1; or, as shown by a solid line in FIG. 1, a distributive feeding nozzle c for atomizing the liquid material is disposed at the upper end part of the tube 1 or at a position above the upper end part thereof, to which position the downstream side of the tube passageway, leading the liquid material to this distributive feeding nozzle is connected, thereby atomizing the liquid material from the distributive feeding nozzle cover to the inner wall surface 1*a* of the tube 1, whereby the liquid material may sequentially flow downward over the entire surface of the inner wall surface 1*a* of the tube 1; or, as in the embodiment shown in FIG. 2, a pipe 40 formed in a thin long rod shape is disposed at the axial part of the inner bore of the tube 1, on the peripheral surface of which a multitude of ejection ports 41, 41, . . . are perforated, and a pipe passageway 4 is connected to the downstream side thereof to lead the liquid material, thereby atomizing the liquid material from a multitude of ejection ports 41, 41, . . . over the substantially entire surface of the inner wall surface 1*a* of the tube 1. Other expedients may, of course, be adopted.

As soon as the liquid material, as fed into the tube, becomes frozen on the inner wall surface 1*a* of the tube 1 to be cooled by the heat medium in the jacket 2, in a frozen layer of a predetermined thickness, unfrozen liquid material is taken out of a liquid discharge tube 5 kept connected at a position above the valve V1 provided on the bottom part of the tube 1, thereby causing the liquid material to freeze on the inner wall surface 1*a* of the tube 1, in the form of a hollow cylindrical molded frozen body M.

Then, sublimation heat is imparted to this molded frozen body M from the heat medium circulated within the jacket 2 to sublimate the moisture content in the material, thereby constituting the freeze-drying apparatus W which causes the liquid material to freeze-dry by capturing and removing the water vapor with use of the vacuum discharge system through the duct 3 communicatively connected to this discharge system.

The freeze-drying apparatus W of such construction defines a downwardly opening discharge port d at the lower end side of the upright cylindrical tube 1, and, from this discharge port d, the molded frozen body M of the liquid material, as freeze-dried by freezing the same within the tube 1, can be effected.

This discharge port d needs not be shaped in such a configuration that enables the molded frozen body M, as frozen and desiccated within the tube, to be discharged in its shape as it is, but, as is the case with the embodiment shown in the drawing, it may be opened, in the bottom wall of a connecting cylindrical portion 10 to connect the valve V1 for assembling at the lower end side of the tube 1, in the form of a through-hole having a much smaller diameter than the inner diameter of the tube, where a conveying tube e may be connected.

Moreover, at the upper end side of the tube 1 or the base end side of the duct 3 connected to the tube, there is provided a pressurized fluid nozzle n to eject pressurized air or gas to be introduced from a compression pump P1 or a bombe B, and, by ejecting the pressurized fluid from this pressurized fluid nozzle n, the pressurized fluid is made to flow in the inner bore of the tube 1 toward the discharge port d at the lower end side in a state of the discharge port d being opened with the valve V1 made open.

Within the tube 1, which assumes this state, there are disposed a plurality of jet nozzles N, N, . . . for ejecting the pressurized air or gas current to crush and pulverize the molded frozen body M of the liquid material, which was frozen and desiccated in the tube 1.

These jet nozzles N, N, . . . may be provided either at the axial part in the inner bore of the tube 1 so as to eject the jet current from the axial position of the hollow cylindrical molded frozen body M toward the cylindrical frozen layer of the molded frozen body M, or at the inner wall surface 1*a* of the tube 1 so as to eject the jet current from the outer peripheral side of the molded frozen body M toward the molded frozen body M.

When the jet nozzle N is disposed at the axial part of the tube 1, a pipe 40 in the form of a thin long rod having a multitude of ejection ports 41, 41, . . . for distributively feeding the liquid material perforated in the peripheral surface thereof, as in the embodiment shown in FIG. 2, a change-over valve V3 is provided in the pipe passageway 4 of the liquid material, connected to the pipe 40, to which a compression pump P1 or bombe B, filled with pressurized air or gas is connected, so as to cause the pressurized air or gas to be ejected from the ejection ports 41, 41, . . . by the actuation of the change-over valve V3, and to cause the ejection ports 41, 41, . . . , which are the nozzle for distributive feeding of the liquid material to be co-used with the jet nozzles N, N, . . . . Such arrangement is possible and feasible.

In the case of disposing the jet nozzles N, N, . . . at the side of the inner wall surface 1*a* of the tube 1, the nozzle main bodies 60, 60, . . . to be connected to a source of pressure of the pressurized air or gas are assembled with the jacket 2 surrounding the outer periphery of the tube 1, as the embodiment shown in FIG. 2, and the nozzle port to be provided at the forward end side of the tube 1 is caused to face the inner bore of the tube 1 by way of a through-hole to be perforated in the cylindrical wall of the tube 1, thereby providing the nozzle port in the inner wall surface 1*a* of the tube 1. At this time, the ejecting direction of the jet current from the nozzle port of the jet nozzle N is made to be slanted in the tangential direction of the inner wall surface 1*a* of the tube 1.

In this manner, the jet nozzles N, N, . . . provided at the inner surface side of the upright cylindrical tube 1 to constitute the desiccating chamber of the freeze-drying apparatus N function to open the valve V1 at the lower end side of the tube 1, when the molded frozen body M of the liquid material, which is frozen in the tube 1, completes its freeze-drying, actuates this jet nozzle N, in a state of the pressurized fluid nozzle being actuated by opening of the discharge port d with the valve V1 at the lower end side of the tube 1 being opened, whereby the cylindrical molded frozen body M, which is freeze-dried within the tube, becomes sequentially crushed and pulverized within the tube 1 by the jet current ejected from the jet nozzle N. The resulting pulverized product is discharged from the discharge port together with discharging pressurized fluid.

At this time, the conveying tube e is connected to the discharge port d, as shown in the illustrated embodiment, the pulverized product becomes air-transported to a desired location. Also, the forward end side of the conveying tube e is communicatively connected to an intake port of a pulverizer 71 equipped with a cyclone 70, or an intake port 73 of the cyclone 70, thereby making it possible to take out the pulverized product from the take-out port 74 of the cyclone 70 by separating the pulverized product from the pressurized fluid.

By the way, mention is made as to the reference numerals of the constituent parts of the freeze-drying apparatus according to the present invention. That is to say, in FIGS. 1 and 2, a reference numeral 2*a* designates a refrigerator; a reference numeral 2*b* designates a heat-exchanger for the heat medium to be circulated in and through the jacket 2; a numeral 2*c* refers to a circulating path of the heat medium; and a numeral 2*d* denotes a heating device. Further, a reference numeral t1 designates a tank for recovering unfrozen liquid which has been taken out of a liquid discharging tube 5; and P2 refers to a pump for pumping-up and storing the unfrozen liquid as recovered into the second tank t2.

Figure 3:
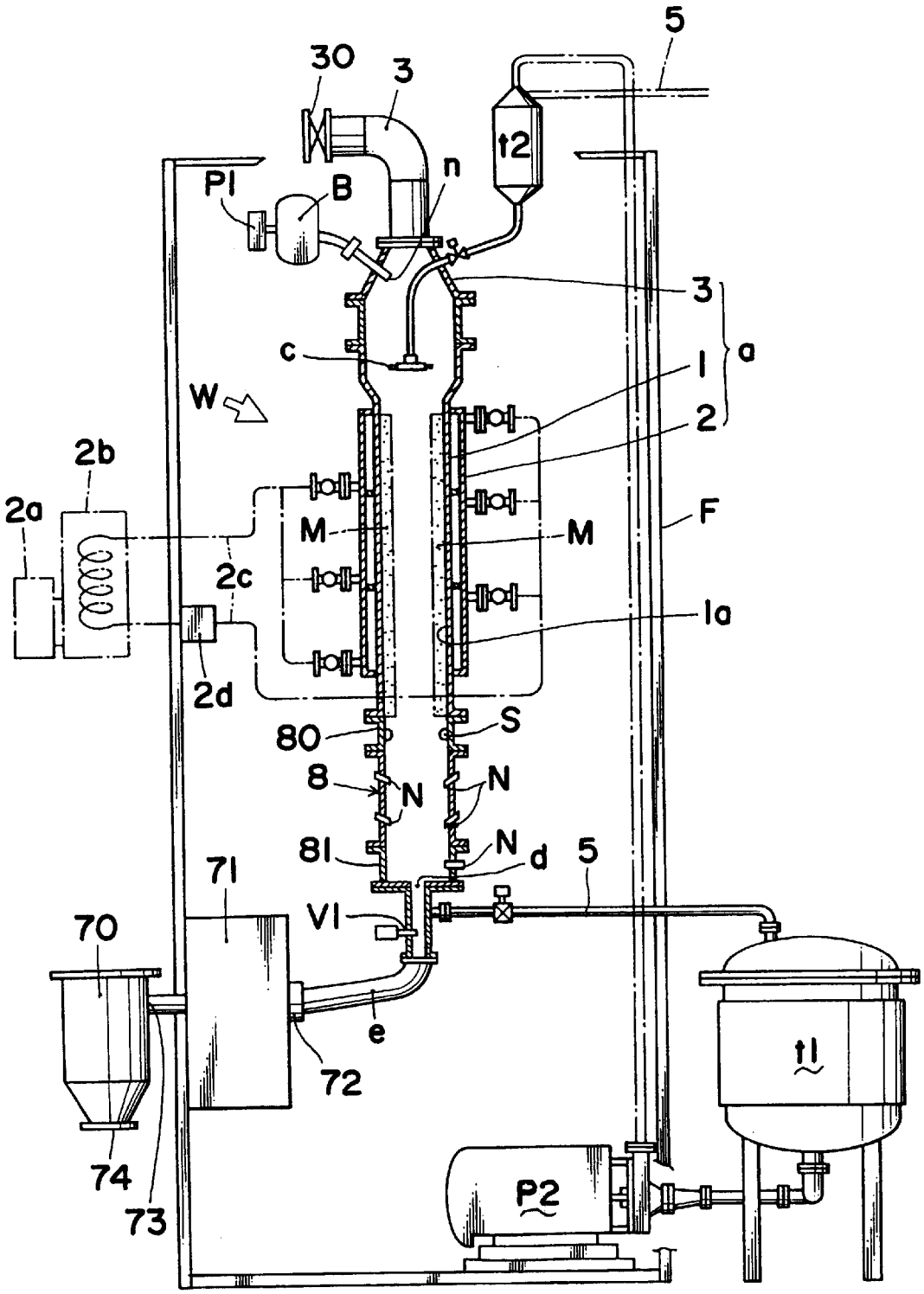
FIG. 3 is an overall front view, partly in longitudinal cross-section, of still another embodiment of the pulverizing device for desiccated bulk product in the freeze-drying apparatus for foodstuffs, medicaments, and so forth, according to the present invention.

FIG. 3 illustrates a different embodiment. In this embodiment, a cylindrical chamber 8 is connected to the lower end side of the upright cylindrical tube 1, and a discharge port d is defined in the bottom part thereof, whereby the pressurized air to be blown out of the pressurized fluid nozzle n provided at the side of the duct 3 is kept discharged from the discharge port d, passing through the inner bore of the tube 1 and subsequently the chamber 8. Further, in this embodiment, by providing, in the inner wall surface of this chamber 8, the jet nozzle N for carrying out crushing and pulverizing of the molded frozen body M, which has been freeze-dried in the tube 1, the crushing and pulverizing of the molded frozen body M by the jet current from the jet nozzle N becomes able to be done within this chamber 8, which is connected to the lower end side of this tube 1.

The embodiment shown in FIG. 3 is constructed, without difference from the preceding embodiment, in such a fashion that the main body part a of the freeze-drying apparatus W for freeze-drying the molded frozen body M under the vacuum condition (the molded frozen body M being fed into the tube 1 by means of the upright cylindrical tube 1; the jacket 2 surrounding the outer periphery of the tube 1, and for circulating the heat medium; and the duct 3, communicated with the vacuum discharge system and connected to the upper end side of the tube 1); that the distributive feeding means for feeding the liquid material into the tube 1 is incorporated in this main body a of the freeze-drying apparatus W; and that the pressurized fluid nozzle n for ejecting the pressurized fluid in such a manner as to cause the pressurized fluid to flow within the tube 1 from above toward the discharge port d.

A reference numeral 8 designates the cylindrical chamber connected to the lower end side of the tube 1. This connection of the chamber 8 is effected by joining a connecting jaw formed at the upper end side of this chamber with a connecting jaw formed at the lower end side of the tube 1. Between these connecting jaws, there is interposed a connecting cylinder 80 of a short length, in the form of a spacer. The inner wall surface of this connecting cylinder 80 has a holding member S which functions to prevent the molded frozen body M, frozen and desiccated within the tube 1, from slide-dropping into the chamber 8.

Figure 4:
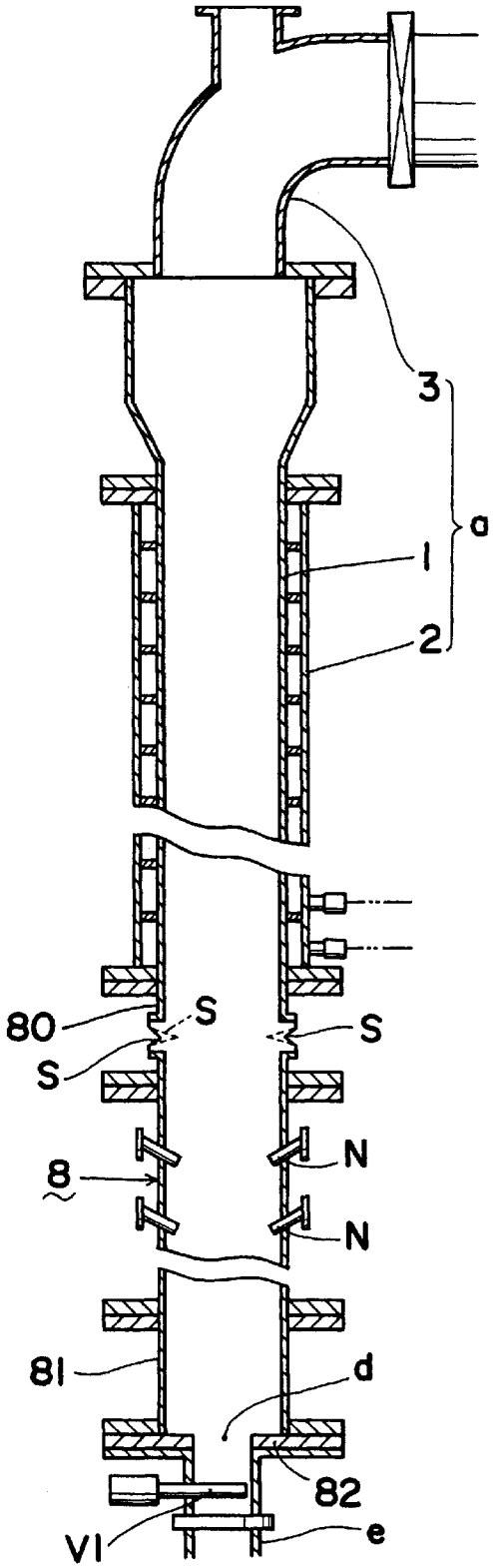
FIG. 4 is a longitudinal cross-sectional view showing the main part of a modified embodiment of the pulverizing device according to the present invention.

This holding member S is formed of a diaphragm, which deforms from its state-position as shown by the solid line in FIG. 4 to its another state-position as shown by the dotted line, so as to hold the lower edge of the molded frozen body M which is dropping down slidingly.

The jet nozzles N, N, . . . to be mounted on the inner surface side of the cylindrical chamber 8, as connected, are so constructed that these jet nozzles are downwardly inclined, as shown in FIG. 4, to take a state of downward inclination, and moreover that they are slanted in the direction running along the tangential line of the inner wall surface of the chamber 8 so as to form a gyratory current within the chamber 8.

The discharge port d provided in the bottom part of the chamber 8 is defined by connecting a short connecting cylinder 81 having a bottom wall 83, and this discharge port d is opened in this bottom wall 83 with a small diameter. By connecting the conveying tube e to this discharge port d, the pulverized product to be discharged from the discharge port d is air-transported to the crushing machine, the cyclone 70, and so forth.

Figure 5:
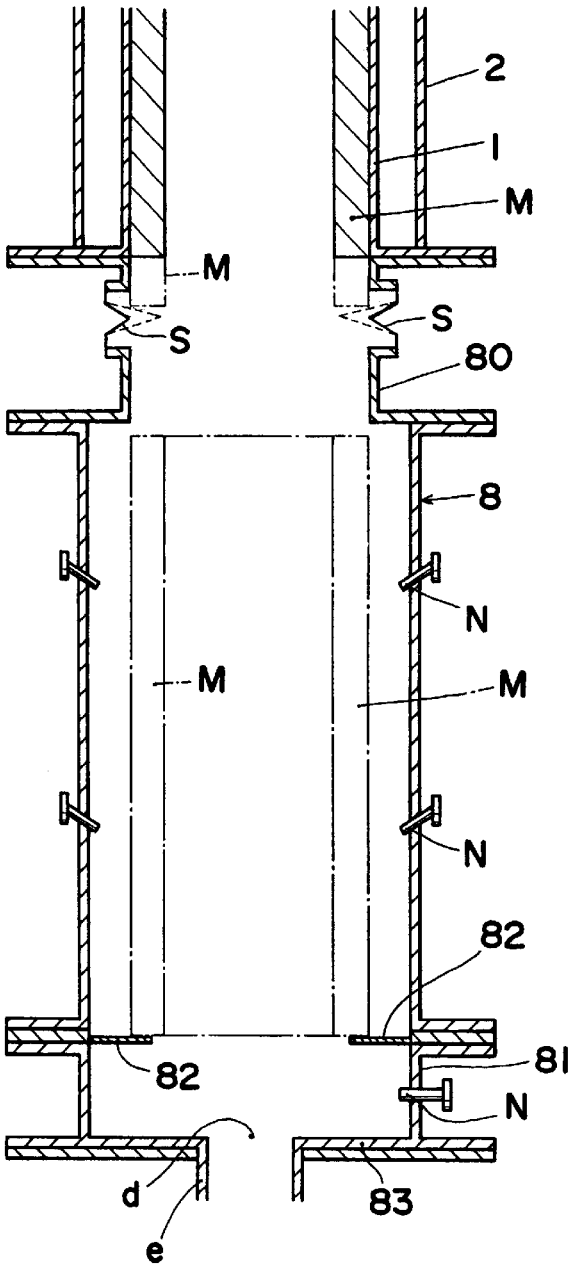
FIG. 5 is a longitudinal cross-sectional view showing the main part of another modified embodiment of the pulverizing device according to the present invention.

In the next place, FIG. 5 shows a modified embodiment of those as illustrated in FIGS. 3 and 4, as mentioned above. By forming the chamber 8 connected to the lower end side of the tube 1 in a larger diameter than the inner diameter of the tube 1, when the molded frozen body M, which has been frozen within the tube 1, finishes its desiccation, and the holding member S is retracted, the molded frozen body M, which has finished its desiccation, is caused to drop into the chamber 8, whereby falling of the molded frozen body M into the chamber 8, when it is crushed and pulverized by the jet current from the jet nozzles N, N, . . . is realized smoothly, and the crushing and pulverizing operations of the molded frozen body M, which has dropped, can be done adequately.

In this embodiment, an annular plate 82 having an orifice (or opening) to hold the lower edge of the molded frozen body M, which has dropped down, is disposed on the upper end side of the short connecting cylinder 81 which is connected for providing the discharge port d, in the bottom part of the chamber 8, so that the molded frozen body M can be subjected to crushing and pulverization by the jet nozzles N, N, . . . disposed in the inner surface of the chamber 8, in the state of its being supported above the discharge port d at the bottom part of the chamber 8.

Also, the jet nozzle N is provided in the inner bore of the connecting cylinder 81 between the bottom wall 83 of the connecting cylinder 81 having the jet nozzle N, so as to be able to pulverize the crushed material which falls down into this inner bore 81.

Figure 6:
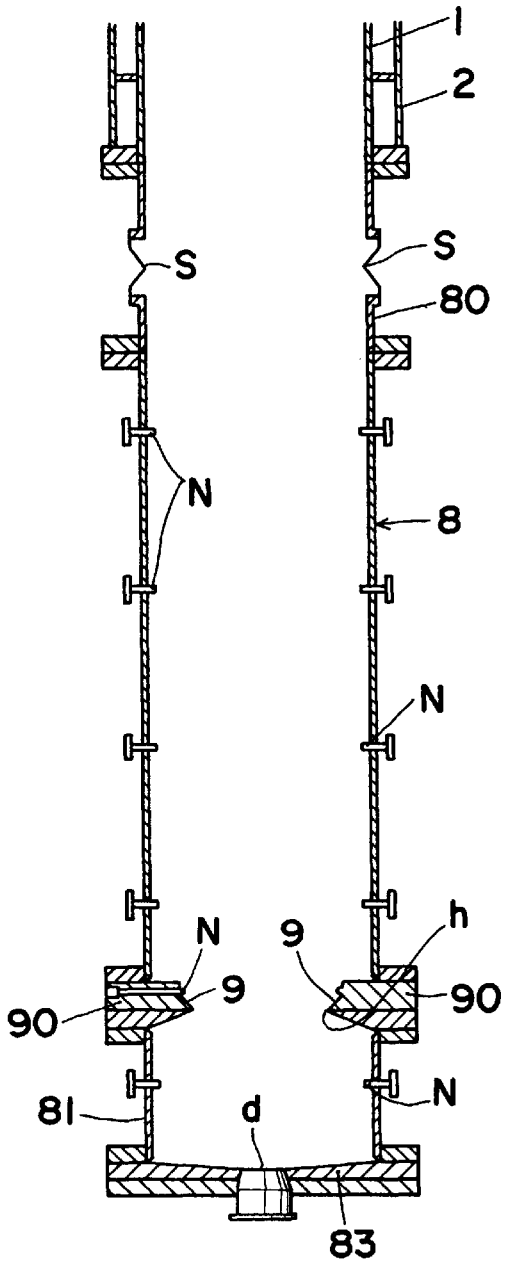
FIG. 6 is a longitudinal cross-sectional view showing the main part of still another modified embodiment of the pulverizing device according to the present invention.

Further, in the embodiment shown in FIG. 6, the jet nozzle N is disposed, at a position immediately above the orifice h at the side of the lower part, to eject the jet current against the molded frozen body M held on this orifice h as well as the crushed material of this molded frozen body M.

Figure 7:
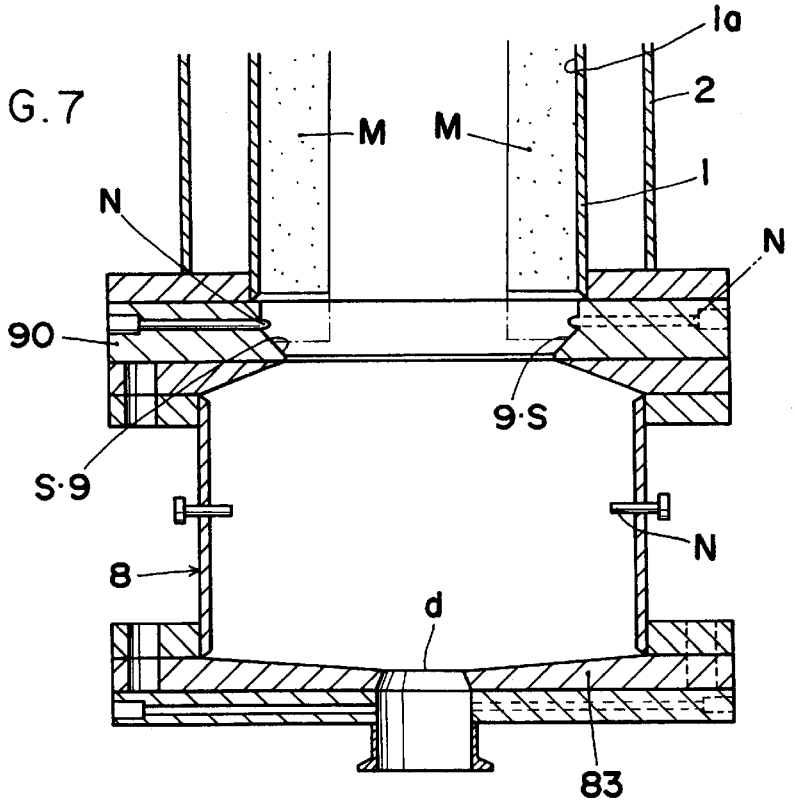
FIG. 7 is a longitudinal cross-sectional view showing, in part, the main part of other embodiment of the pulverizing device according to the present invention.

FIG. 7 further illustrates a different embodiment. According to this embodiment, the holding member S interposed between the lower end side of the tube 1 and the upper end of the chamber 8, for suppressing the slide-dropping of the molded frozen body M, which has been frozen and dried in the tube 1, is given a configuration of a funnel-shaped inclined wall 9, the diameter of which becomes gradually reduced as it goes downward.

This inclined wall 9 constitutes a ring-shaped assembling member 90 which is to be interposed between the upper end part of the chamber 8, which is assembled to the lower end side of the tube 1, and the lower end side of the tube 1 so as to integrally form this funnel-shaped inclined wall 9 on the inner wall surface of the tube, whereby, when this inclined wall 9 takes its position at the lower end of the tube 1, and when the molded frozen body M slidingly dropped onto this position, the lower edge of this molded frozen body M comes into contact with the upper surface of this inclined wall 9 to be held thereon.

Onto this ring-shaped assembling member 90, there is provided the jet nozzle N for ejecting pressurized air or gas, at a position immediately above the funnel-shaped inclined wall 9 disposed at that place, so as to grind and pulverized the lower edge of the molded frozen body M held on the inclined wall 9 by means of the jet current.

Figure 8:
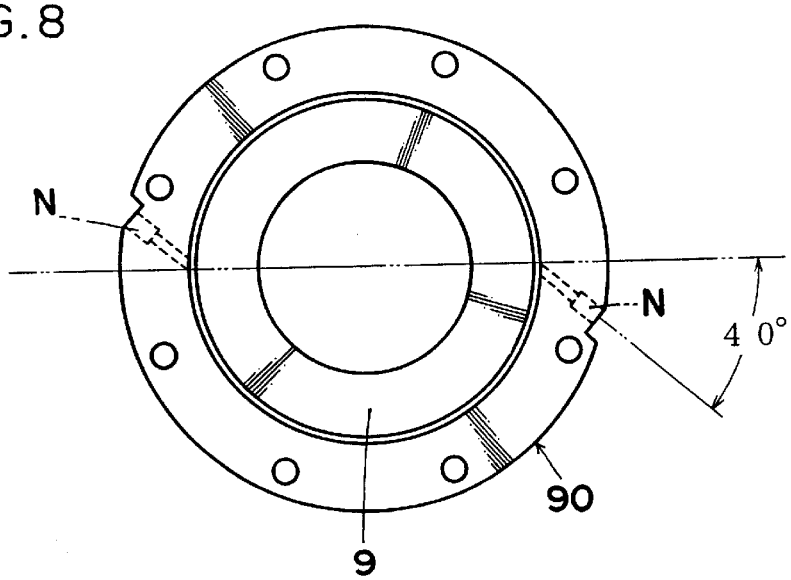
FIG. 8 is a plan view showing a part of the abovementioned embodiment of the pulverizing device shown in FIG. 7.

Also, as shown in FIG. 8, each of the jet nozzles N, N, . . . to be assembled to this assembling member 90 has its direction of ejecting the jet current inclined at approximately 40 degrees with respect to its radial directional line extending from the center of the chamber 8, whereby the blowing of the jet current to the peripheral surface of the molded frozen body M held on this inclined wall 9 may not become localized. Furthermore, these jet nozzles N are made to operate intermittently, so that the sequential crushing of the molded frozen body M may be effected at a desired speed.

In this embodiment, too, the chamber 8 is designed to receive thereinto the crushed material which is sequentially ground and dropped down from the molded frozen body M by means of the jet nozzles N disposed above the above-mentioned inclined wall 9. Thus, since it becomes no longer necessary to correspond the length of the jet nozzles in both upper and lower positions to the shape and size of the molded frozen body M, they can be shaped in a short length in both upper and lower positions. However, their inner diameter is made larger than the inner diameter of the tube 1 to increase its capacity in the radial direction.

Figure 9:
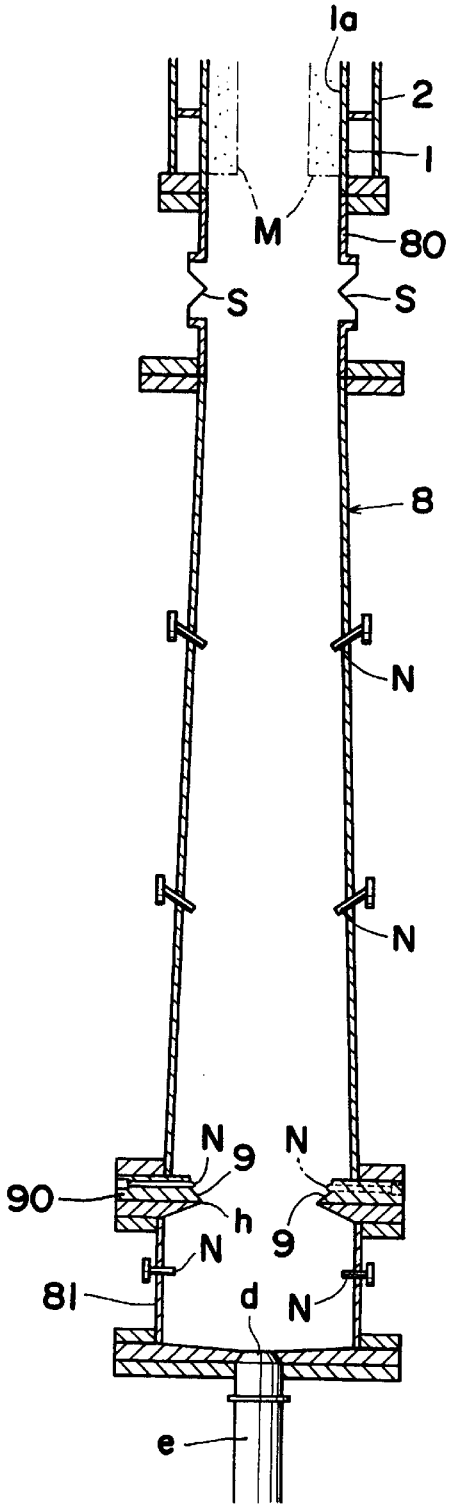
FIG. 9 is a longitudinal cross-sectional view showing the main part of still other embodiment of the pulverizing device according to the present invention.

In the next place, FIG. 9 further illustrates a separate embodiment of the present invention. According to this embodiment, the chamber 8 connected to the lower end side of the tube 1 is shaped in a truncated conical form, the diameter of which increases gradually as it goes downward. In this construction, arrangement is so made that, at the time of carrying out crushing and pulverizing of the molded frozen body M with use of the jet current from the jet nozzles N, N, . . . disposed in the chamber 8, in a state of the pressurized fluid from the pressurized fluid nozzle n disposed at the upper end side of the tube 1 or to the side of the duct 3 blowing in and through the chamber 8, the crushed material or the pulverized material may flow downward along the inner wall surface of the chamber 8, constituting the inclined surface owing to the centrifugal force imparted thereto by its gyration by the gyratory current produced within the chamber 8 due to the jet current from the jet nozzles N, N, . . . , so that there may take place no upward reverse flow of the crushed material.

In this embodiment, too, since the jet nozzles N, N, . . . to be provided in the inner surface of the chamber 8 are inclined their direction of ejecting the jet current, at a predetermined angle, with respect to the radial direction from the center of the chamber 8, and are mounted in a manner to be inclined downward. Therefore, even at a position immediately above the orifice h at the side of the lower part, arrangement is so made as to mounting the jet nozzle N for ejecting the jet current, with respect to the molded frozen body M held on the orifice h as well as to the crushed product thereof.

Figure 10:
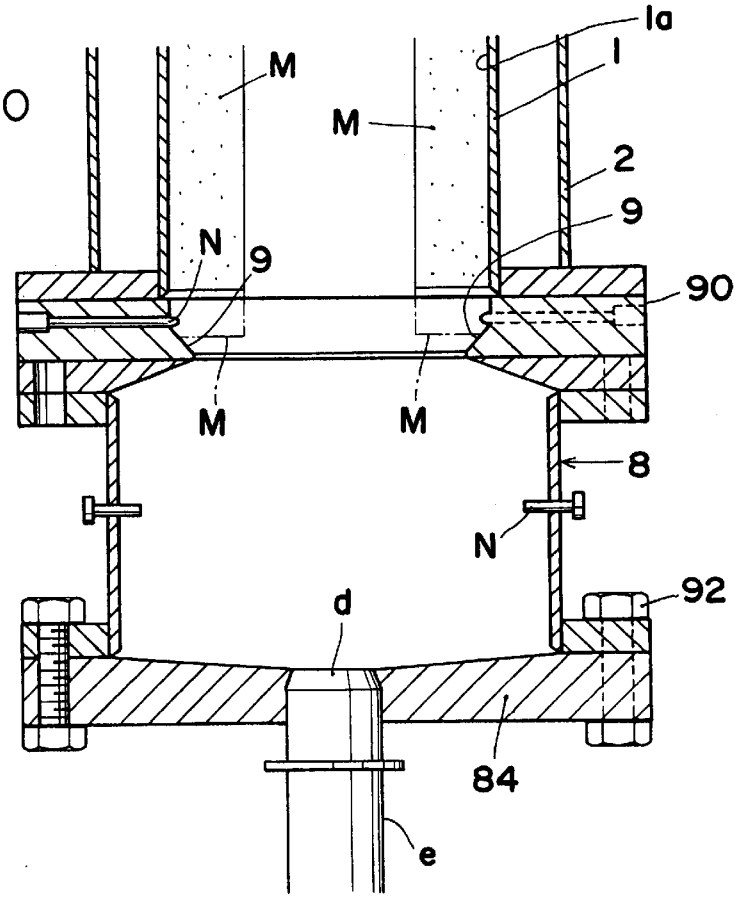
FIG. 10 is a longitudinal cross-sectional view showing, in part, the main part of a different embodiment of the pulverizing device according to the present invention.

In the next place, FIG. 10 further illustrates a different embodiment. In this embodiment, by adjusting the displacement position of the discharge port d to be provided at the bottom part of the chamber 8 connected to the lower end side of the tube 1 with respect to the axial line of the chamber 8, the degree of crushing of the molded frozen body M is made adjustable by the jet current from the jet nozzles N, N, . . . within the chamber 8.

In this figure of drawing, a reference numeral 1 designates the upright cylindrical tube; a reference numeral 2 refers to the outer cylindrical jacket to cover the cylindrical tube; a reference numeral 8 denotes the cylindrical chamber to be connected to the lower end side of the tube 1; a reference numeral 90 designates a ring-shaped assembling member, which is interposed between the chamber 8 and the above-mentioned tube 1; and a reference letter d denotes the discharge port defined in the bottom part of the chamber 8. These component members are invariably in the same construction as that of the embodiment shown in FIG. 8, with the exception that the bottom wall 84, where the discharge port d is defined, is separately formed with respect to the bottom part of the chamber 8, and is assembled in a freely mountable and dismantled manner with use of set bolts 92, 92, . . . .

And, this bottom wall 84, which is separate from the chamber 8, is formed in many types: such as those, wherein the open position of the discharge port d formed in the bottom wall is positioned on the center line of the chamber 8, as the bottom wall 84 shown in the drawing; and such as those, wherein the discharge port d is defined at a position deflected sidewise with respect to the center line thereof, and its deflecting quantity is differentiated from one to the other. Such various types of the bottom walls can be exchanged depending on necessity for assembly.

And also, the crushing and pulverizing of the molded frozen body M to be carried out in the chamber 8, which is connected to the lower end side of the tube 1, is done by the jet current ejected from the jet nozzle N mounted in the inner surface side of the cylindrical wall of the chamber 8 with such inclination that the ejecting of the jet current may take a direction which follows the inner wall surface of the chamber 8, when the molded frozen body M, which has completed desiccation within the tube 1 and causes its lower end edge to be held on the holding member S, is sequentially crushed from the lower end side by means of the jet nozzles N, N, . . . which are disposed above the holding member S or its neighborhood position, to be dropped into the chamber 8; at the same time, by gyrating the crushed and pulverized material aboard the gyrating current to be produced within the chamber 8 by the jet current, pulverization of the frozen and desiccated material can be carried out by the collision among the gyrating crushed material themselves, and collision of the gyrating crushed material against the inner wall surface of the chamber 8.

From this fact, when the discharge port d is at the center position of the bottom wall 84, these crushed material and pulverized material, which are gyrating within the chamber 8, are difficult to come closer to the discharge port d situated at the center thereof, hence a longer time is taken for the steps of crushing and pulverizing in the chamber 8, the degree of crushing and pulverization of these crushed material as well as pulverized material to be discharged from the discharge port d becomes high. Moreover, if and when the discharge port d is on the circumferential part of the bottom wall 84, the crushed and pulverized materials, in gyration, becomes readily produced, whereby the steps of crushing and pulverizing the desiccated material in the chamber 8 tend to be finished within a short period of time, with consequent decrease in the degree of pulverization.

Accordingly, by changing the position of the discharge port d through exchange of the bottom wall 84 in a mountable and dismountable manner, it becomes possible to adjust the degree of pulverization.

Figure 11:
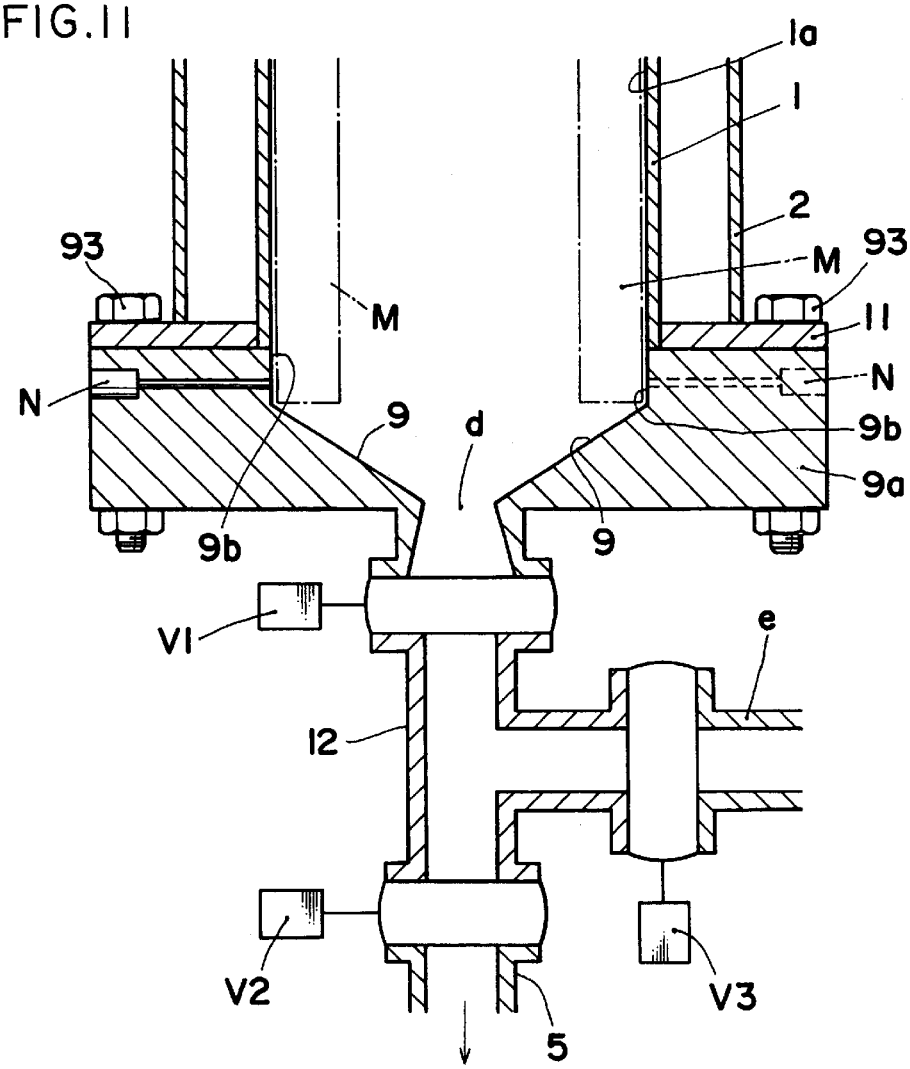
FIG. 11 is a longitudinal cross-sectional view showing, in part, the main part of a still different embodiment of the pulverizing device according to the present invention.

In the next place, FIG. 11 is a longitudinal cross-sectional view of the main part of other different embodiment of the present invention. This embodiment is such one that the funnel-shaped inclined wall 9 is disposed at the lower end side of the tube 1, while the jet nozzles N, N. . . . are disposed for crushing and pulverizing the molded frozen body M of the liquid material which has been frozen and desiccated in the cylindrical form on the inner wall surface 1*a* of the tube 1, whereby the molded frozen body M which has completed its desiccation and held on the wall surface of the inclined wall 9 is crushed and pulverized sequentially with use of the jet current through the jet nozzles N, N, . . . from the lower end side thereof.

In this figure of drawing, a reference numeral 1 designates the upright cylindrical tube; a reference numeral 2 denotes the jacket disposed around the outer periphery of the tube 1 in a manner to surround the same in an outer cylindrical form. The illustration shows the lower half part alone, while the upper half part is omitted, although, same as in the aforementioned embodiment, the duct 3*c* is communicatively connected to the vacuum exhaust system, and the circulating path 2*c* of the heat-exchanger 2*b*, through which the heat medium circulates, is connected to the jacket 2.

The lower half part of these tube 1 and jacket 2 are assembled in the form of a double-cylinder, which are integrally joined by a connecting jaw 11.

The funnel-shaped inclined wall 9 to be provided at the lower end side of the tube 1 is formed by conically hollowing out the inner surface side of a block 9*a* in a disc-shape to be assembled by means of a set-bolt 93 onto the abovementioned connecting jaw 11.

In this case, a circular groove with a shallow inner diameter in correspondence to the inner diameter of the tube 1 is formed in the upper surface side of the disc-shaped block 9*a*, to which the funnel-shaped inclined wall 9 continues from the lower end of the vertical wall surface 9*b* of the block 9*a*. When the block 9*a* is connected to the abovementioned connecting jaw 11, the lower end side of the inner wall surface 1*a* of this tube 1 is made to be continued to this circular groove.

The jet nozzle N is provided in the vertical wall surface 9*b* of this circular groove in such a manner that the nozzle port may be opened from this wall surface to eject the pressurized air or gas.

The lower end side of the funnel-shaped inclined wall 9 is cut out deep into the discharge port d which is open to the center portion of the block 9*a* so as to be communicatively connected thereto. By so positioning the nozzle N, the crushed material and the pulverized product can be discharged from the discharge port d, as they are treated by the jet current from the abovementioned jet nozzle.

To the discharge port d, there is connected a connecting cylinder 12 through the valve V1, to which there is connected a conveying tube e in the form of a side branch through a valve V3. Below the connecting cylinder 12, there is further connected a liquid discharging tube 5 through a valve V2, with which the inclined wall 9 may become usable for discharging the liquid material which remains unfrozen.

In some case, a pressurized fluid nozzle n for ejecting the pressurized air or gas is assembled to the upper end side of the tube 1 or the duct 3.

As has so far been described in the foregoing, the crushing and pulverizing device for foodstuffs, medicaments, etc. in the freeze-drying apparatus according to the present invention is so constructed that the liquid material for foodstuffs, medicaments, and so forth is caused to freeze, as a molded frozen body of a hollow cylindrical shape, in the upright cylindrical tube to constitute the desiccating chamber of the freeze-drying apparatus, wherein, as soon as the freeze-drying is terminated, pressurized fluid is blown from the upper part in the tube through to the discharge port, in which state the freeze-dried material on the inner wall surface of the tube is crushed by jet current from the jet nozzles provided within the tube, and the crushed product is dropped into the chamber connected to the lower end side of the tube, where it is pulverized by the jet current ejected from the jet nozzles. Therefore, it is possible to carry out crushing and pulverizing of the desiccated bulk product of the liquid material such as foodstuffs, medicaments, and so forth, which have completed their desiccation, substantially within the machine body of the freeze-drying apparatus, thereby making it possible to remarkably reduce the installation cost and operating steps, for prevention of the risk of contamination.

Although the present invention has been described in detail with reference to the specific modes of embodiment as shown in the accompanying drawing, it should be understood that the invention is not limited to these embodiments alone, but any changes and modifications may be made within the spirit and scope of the invention as recited in the appended claims.

What is claimed is:

1. A freeze-drying apparatus for foodstuffs and medicaments comprising:

an upright cylindrical tube for freezing liquid material onto the inner wall surface; a jacket surrounding the outer periphery of said tube to cause heat medium to circulate in its interior; and a duct communicatively connected to a vacuum exhaust system which is connected to the upper end side of said tube, a crushing device, characterized in that said liquid material is frozen on the inner wall surface of said tube as a molded frozen body in a cylindrical form, then the moisture content in the material of said molded frozen body is sublimated under the vacuum condition to desiccate the liquid material by the freeze-drying, that a discharge port is provided at the lower end side of said tube, while a jet nozzle for ejecting pressurized air or gas toward the inner bore of said tube is disposed in the inner wall surface of said tube, thereby making it possible to crush the molded frozen body of said liquid material which has been freeze-dried within the tube, by means of the jet current ejected from the jet nozzle.

2. A freeze-drying apparatus for foodstuffs and medicaments comprising:

an upright cylindrical tube for freezing liquid material onto an inner wall surface; a jacket surrounding the outer periphery of said tube to cause heat medium to circulate in its interior; and a duct communicatively connected to a vacuum exhaust system which is connected to the upper end side of said tube, a crushing device, characterized in that a discharge port is provided at the lower end side of said tube, and a jet nozzle for ejecting pressurized air or gas against the inner wall surface of said tube is provided at an axial part in the interior of said tube, to thereby pulverize a molded frozen body as freeze-dried in said tube by means of the jet current from the jet nozzle.

3. The freeze-drying apparatus for foodstuffs and medicaments, according to claim 1 or 2, characterized in that a pressurized fluid nozzle for ejecting pressurized air or gas into the upper end side of the tube or into the duct connected to said upper end side of the tube is disposed in such a manner that said pressurized fluid ejected from said nozzle is blown in and through said tube from the upper part thereof toward the discharge port at its lower part, thereby making it possible that pulverization of the molded frozen body of said liquid material, which has been freeze-dried by freezing the same in said tube with the jet current from the jet nozzle disposed within said tube, is effected in the flow of the pressurized fluid which is blowing from the upper part to the lower part within the tube, in and through the pressurized fluid nozzle.

4. A freeze-drying apparatus comprising:

an upright cylindrical tube for freezing liquid material onto an inner wall surface thereof, a jacket surrounding the outer periphery of said tube to cause heat medium to circulate in its interior; and a duct communicatively connected to a vacuum exhaust system which is connected to the upper end side of said tube, said liquid material being frozen on the inner wall surface of said tube in the form of a cylindrical molded frozen body, and sublimating the moisture content in the material of said molded frozen body under the vacuum condition to freeze-dry the molded frozen body, a pulverizing device for desiccated bulk product in the freeze-drying apparatus for foodstuffs and medicaments, characterized in that a funnel-shaped inclined wall, for holding said molded frozen body in close contact with the lower edge thereof, which has completed its freezing and drying within the tube, is mounted on the lower end side of said tube; that a jet nozzle for ejecting the jet current of pressurized air or gas against molded frozen body, as desiccated, the lower edge side of which is held on said inclined wall thereof, is mounted on the lower end part of the inner wall surface of said tube, at a position on the wall surface of the inclined wall or above its inclined wall, a discharge port being formed at the inclined descending side of the inclined wall to thereby comminute the molded frozen body sequentially from its lower end side with use of the jet current from the jet nozzle and to discharge the pulverized product from the discharge port.

5. The freeze-drying apparatus for foodstuffs and medicaments according to claim 4, characterized in that a pressurized fluid nozzle for ejecting pressurized air or gas is provided on the upper end side of the tube or on the duct connected to the upper end side of the tube, in such a manner that the pressurized air or gas ejected therefrom may be blown in and through the inner bore of the tube from the upper part down to the discharge port below, by way of the inner bore of the tube and the inner bore of the funnel-shaped inclined wall, thereby making it possible that sequential crushing of the molded frozen body of the liquid material, which has been freeze-dried by freezing the same within the tube by the jet current from the jet nozzle provided at the lower end side of the tube, may be done within the flow of the pressurized fluid which is blown in the tube as well as the funnel-shaped inclined wall, through the pressurized fluid nozzle in the direction of from the upper position toward the discharge port.

6. A freeze-drying apparatus, comprising:

an upright cylindrical tube for freezing liquid material onto an inner wall surface thereof, a jacket surrounding the outer periphery of said tube to cause heat medium to circulate in its interior; and a duct communicatively connected to a vacuum exhaust system which is connected to the upper end side of said tube, said liquid material being frozen on the inner wall surface of said tube in the form of a cylindrical molded frozen body, and sublimating the moisture content in the material of said molded frozen body under the vacuum condition to freeze-dry the molded frozen body;

a pulverizing device, characterized in that a cylindrical chamber with the discharge port being defined in the bottom part of the tube is connected to the lower end side of the tube having an opening provided in the lower part thereof;

a jet nozzle for ejecting jet current of pressurized air or gas is mounted on the inner surface side of the chamber, to thereby pulverize the molded frozen body of the liquid material, as freeze-dried in the tube, with the pressure as well as the jet current ejected from the jet nozzle.

7. The freeze-drying apparatus for foodstuffs and medicaments according to claim 6, characterized in that a pressurized fluid nozzle for ejecting pressurized air or gas is provided in the duct to be connected to the upper end side of the tube or to the tube itself, in such a manner that the pressurized fluid to be ejected from the nozzle is blown to the discharge port from the upper part, through the inner bore of the tube or the inner bore of the chamber, whereby crushing of the molded frozen body by the jet current from the jet nozzle to be provided in the inner surface side of the chamber is effected within the flow of the pressurized fluid, which is ejected from this pressurized fluid nozzle and blown within the tube and the chamber, in the direction of from its upper part down to its lower part.

8. The freeze-drying apparatus for foodstuffs and medicaments according to claim 1 or 2, characterized in that, at a part of the lower end side of the tube, or at a part of the upper end side of the chamber connected to the tube, there is disposed a funnel-shaped inclined wall, said inclined wall coming into close contact with the lower edge of the molded frozen body which has completed its freezing and drying within the tube; and that, at a position where the wall surface of the inclined wall is situated, or at a position above the inclined wall, there is disposed at least one jet nozzle to eject jet current of compressed air or gas against the molded frozen body which has completed desiccation, the lower edge side of which is held on the inclined wall.

9. The freeze-drying apparatus for foodstuffs and medicaments according to claim 4, characterized in that said jet nozzle to be disposed above said wall surface of said funnel-shaped wall surface or above said inclined wall is disposed at a predetermined inclined angle with respect to the tangential direction of the peripheral surface of the molded frozen body, and with respect to the radial direction of the molded frozen body.

10. The freeze-drying apparatus for foodstuffs and medicaments according to claim 4 or 5, characterized in that the jet nozzle to be disposed above the wall surface of the funnel-shaped inclined wall or above the inclined wall is so controlled that the action of ejecting the jet current from said nozzle is effected intermittently at a predetermined time interval.

11. The freeze-drying apparatus for foodstuffs and medicaments according to claim 4, characterized in that the funnel-shaped inclined wall to be disposed at the lower end side of the tube or at the upper end side of the chamber, in a manner to hold the lower edge side of the molded frozen body which has frozen and completed its desiccation in the tube, is so made that the lower end edge of the inclined wall form an orifice to reduce the inner diameter of the amber.

12. The freeze-drying apparatus for foodstuffs and medicaments according to claim 3, characterized in that the jet nozzle to be provided in the inner wall surface of the barrel part of a chamber connected to lower end of the tube is disposed with inclination in such a manner that jet current ejected from the nozzle is directed toward the inner wall surface of the chamber, and that, by forming gyrating current which gyrates, in said chamber, along the inner wall surface thereof, the molded frozen body which has completed its desiccation, and falling down from the inner bore of the tube is subjected to floating-rotation by the gyrating current, along with crushing of the molded frozen body due to collision of the crushed material among themselves, and to their crushing due to their collision against the inner wall surface of the chamber, thereby pulverizing the material.

13. The freeze-drying apparatus for foodstuffs and medicaments according to claim 3, characterized in that a cylindrical chamber connected to the lower end side of the tube is formed in a truncated conical shape, the inner diameter of which gradually increases as it goes downward; and that the crushed material of the molded frozen body which has completed its desiccation and floating in gyration with the jet current from jet nozzle is introduced to the bottom side of the chamber by the inclination of the inner wall surface of said chamber.

14. The freeze-drying apparatus for foodstuffs and medicaments according to claim 3, characterized in that a bottom plate is provided in a freely mountable and dismountable manner on the bottom part of a chamber connected to the lower end of the tube, to define at its center part a discharge port at one part of the bottom plate; and that the bottom plate is provided in a plurality of kinds, and the position of the discharge port is made changeable by exchange of the bottom plate in a mountable and dismountable manner, thereby making adjustable the degree of pulverization of the molded frozen body, which has completed its desiccation in the chamber.

15. The freeze-drying apparatus for foodstuffs and medicaments according to claim 1, characterized in that a conveying tube for air-transportation is connected to the discharge port to be defined in the lower end side of the tube or the bottom part of the chamber to be connected with the lower end side of the tube, the pulverized frozen body which has been desiccated by the jet current from the jet nozzle is made to be air-transportable through the conveying tube on the jet current from the jet nozzle.

16. The freeze-drying apparatus for foodstuffs and medicaments according to claim 2, characterized in that a conveying tube for air-transportation is connected to the discharge port to be defined in the lower end side of the tube or the bottom part of the chamber to be connected with the lower end side of the tube, the pulverized frozen body which has been desiccated by the jet current from the jet nozzle is made to be air-transportable through the conveying tube on the jet current from the jet nozzle.

17. The freeze-drying apparatus for foodstuffs and medicaments according to claim 3, characterized in that a conveying tube for air-transportation is connected to the discharge port to be defined in the lower end side of the tube or the bottom part of the chamber to be connected with the lower end side of the tube, the pulverized frozen body which has been desiccated by the jet current from the jet nozzle is made to be air-transportable through the conveying tube on the jet current from the jet nozzle.

* * * * *